United States Patent [19]

Stoker

[11] 3,983,192

[45] Sept. 28, 1976

[54] WATER COOLING ARRANGEMENT

[75] Inventor: Robert J. Stoker, Phillipsburg, N.J.

[73] Assignee: Ingersoll-Rand Company, Woodcliff Lake, N.J.

[22] Filed: Apr. 9, 1975

[21] Appl. No.: 566,267

[52] U.S. Cl. ..... 261/115; 239/550; 261/119 R; 261/DIG. 11

[51] Int. Cl.[2] ..... B01F 3/04

[58] Field of Search ..... 261/119 R, 115, 116, 261/DIG. 11; 239/450, 550

[56] References Cited

UNITED STATES PATENTS

| | | | |
|---|---|---|---|
| 1,778,364 | 10/1930 | Lewis | 261/116 |
| 1,868,632 | 7/1932 | Edge | 261/115 |
| 1,927,073 | 9/1933 | Ruehl | 261/116 |
| 2,547,927 | 4/1951 | Daugherty | 261/115 X |
| 2,591,100 | 4/1952 | Rouse | 261/119 R X |

FOREIGN PATENTS OR APPLICATIONS

| | | | |
|---|---|---|---|
| 198,209 | 11/1957 | Austria | 261/DIG. 11 |
| 492,642 | 7/1919 | France | 261/116 |
| 17,551 | 7/1894 | United Kingdom | 261/115 |

*Primary Examiner*—Frank W. Lutter
*Assistant Examiner*—William Cuchlinski, Jr.
*Attorney, Agent, or Firm*—Frank S. Troidl

[57] ABSTRACT

The arrangement includes a plurality of vertical water pipes with nozzles arranged on the pipes in a manner to minimize interaction between the water droplets coming from the nozzles. The arrangement consists of a plurality of spaced vertical water pipes arranged about a central area with a plurality of vertically spaced water nozzles located on each pipe. The nozzles on each vertical pipe are located along different horizontal planes from the nozzles on the adjacent vertical pipes.

In another arrangement the vertically spaced nozzles on each vertical water pipe are circumferentially spaced from each vertically adjacent nozzle. Groups of vertical water pipes may be concentrically arranged about the central area with the spacing between the groups, the spacing of the vertical water pipes in each group and the location of the nozzles minimizing the interaction of the water droplets from the nozzles.

4 Claims, 6 Drawing Figures

WATER COOLING ARRANGEMENT

This invention relates to water cooling. More particularly this invention is a new arrangement of water pipes and water nozzles connected to said pipes through which the water to be cooled is flowed and sprayed respectively.

Because of possible thermal pollution of rivers and lakes, large quantities of water are required to be cooled before reuse or discharge by industries. The methods presently being practiced include natural and forced draft wet-cooling towers, natural and forced draft dry-cooling towers. However, towers are extremely expensive.

Wet natural draft cooling-towers consist of two major parts: a cooling fill section and a stack. The fill breaks the water up into droplets or sheets to provide a large surface area for heat and mass transfer. The stack generates local movement of air so that it effectively passes through the fill section. Stack heights to 400 feet are not unusual, thus the expense of erecting a stack is a major element in the cost of natural draft cooling-towers.

Other currently utilized water cooling systems include auxiliary air-moving mechanisms such as large fans. An example of the use of auxiliary apparatus to force the flow of air is shown by Koch U.S. Pat. No. 2,887,307. Koch uses a plurality of fans for increasing the flow of air to his water distribution system.

Spray systems have been devised and disclosed which do not use a tower or a stack or a mechanical means, such as a fan, as part of the system. An example of such a system is disclosed in the U.S. Pat. to Edge No. 1,868,632. The spray system shown in the Edge patent discloses a plurality of nozzles and a flat plate adjacent each nozzle. The plates direct the sprays vertically in flat disc-like sprays which overlap one another.

The spray droplets are purposely made to collide with one another, and thus, droplet interference is considered by Edge to be a necessary part of his system.

Many men skilled in the art of cooling towers and cooling water systems have felt that an important part of inducing the flow of air using spray nozzles is to purposely have an arrangement wherein the water droplets collide and intermix. Recently, however, it has been discovered through exhaustive and extensive tests, that the sprays can be used as the prime mover of air through the system, if they are among other things, arranged in a manner to minimize the water droplet interactions. Thus, even with large quantities of water the water sprays can be used as the sole mover of the air through the system resulting in sufficient cooling of the water.

My invention discloses an arrangement for cooling water which does not require the use of a stack or a fan. The system is cheaper than previous systems and requires a minimum of moving parts; the only moving member being the pumps utilized to pump the water to the system for cooling.

Briefly described my new arrangement for cooling water comprises a plurality of spaced vertical water pipes arranged about a central area. A plurality of vertically spaced water nozzles are located on each vertical pipe and adapted to direct the water coming from the nozzles at an angle with respect to the horizontal and toward the central area. The nozzles on each vertical pipe are located along different horizontal planes from the nozzles of the adjacent vertical pipes in one embodiment.

In another embodiment, the nozzles are arranged on the vertical water pipe with each nozzle circumferentially spaced from each vertically adjacent water nozzle. All the nozzles are adapted to direct the flow of water in the same general direction. With large amounts of water to be cooled, the plurality of vertical pipes may be arranged in at least two groups of vertical water pipes concentrically arranged about the central area. The spacing between the groups of vertical water pipes, the spacing of the vertical water pipes in each group, and the location of the nozzles are chosen to minimize the interaction of the water droplets from the nozzles.

The invention as well as its many advantages may be further understood by reference to the following detailed description and drawings in which.

In the various figures, like parts are referred to by like numbers.

Figure 1:
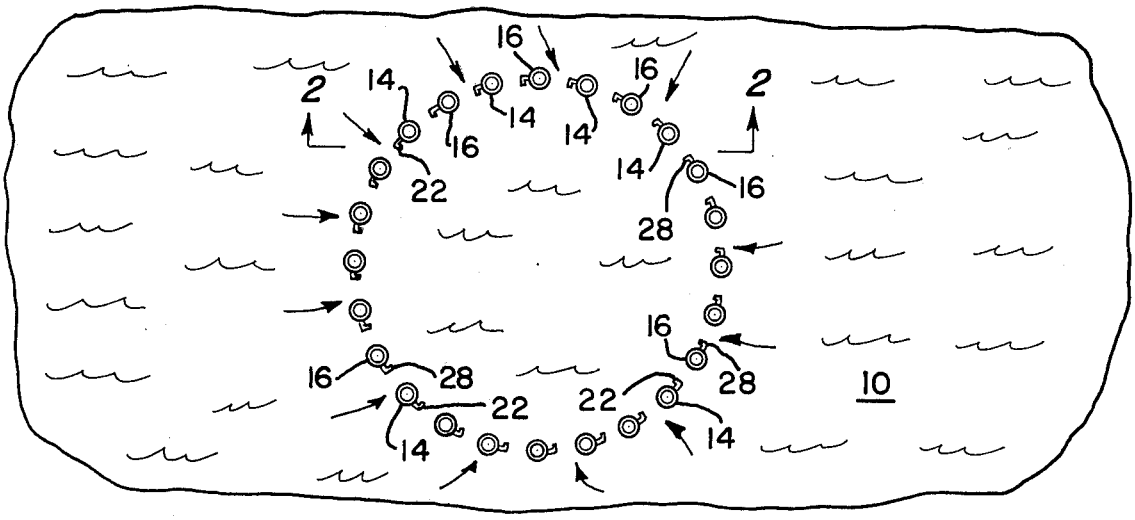
FIG. 1 is a schematic illustration of one embodiment of my invention.
Figure 2:
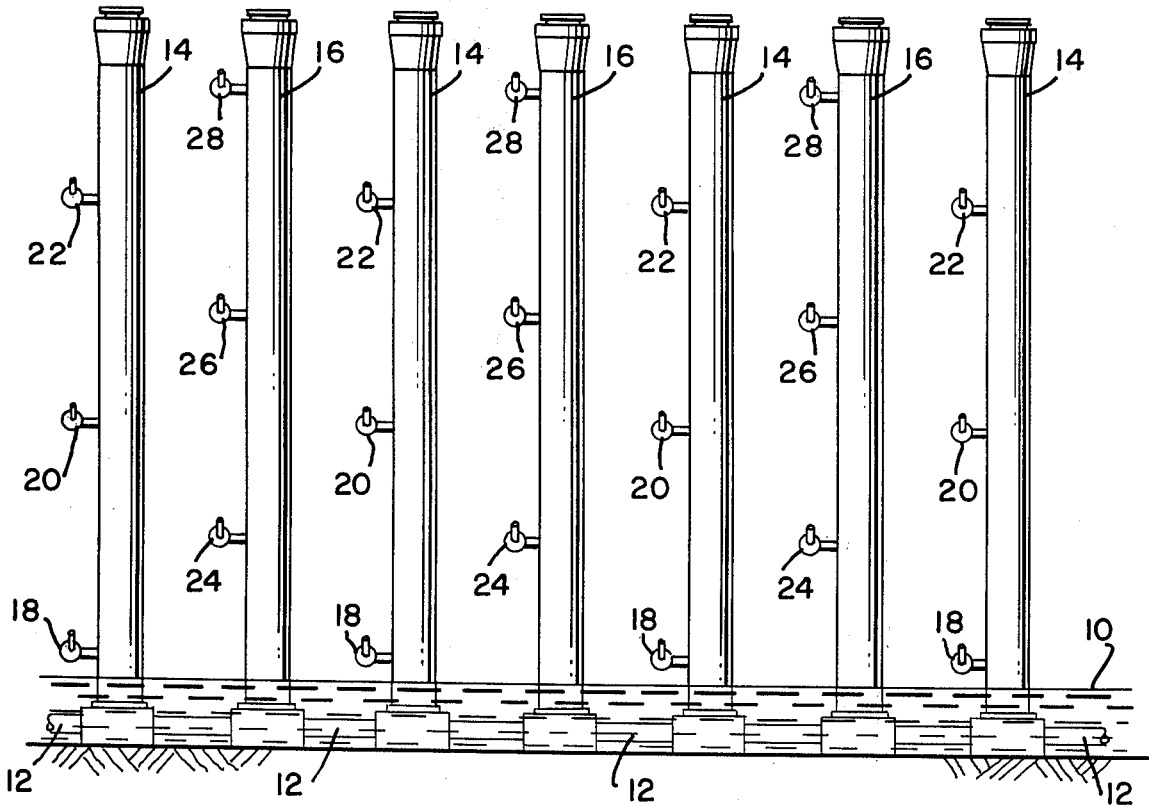
FIG. 2 is a view taken along lines 2—2 of FIG. 1 with the vertical pipes spread flat so as to better illustrate the invention.

Referring to the drawings and more particularly to FIG. 1 and FIG. 2, a pond 10 is shown containing the water to be cooled. An annular ring manifold 12 is located within the pond 10. The vertical water pipes such as pipes 14 and 16 are each provided with a plurality of vertically spaced water nozzles (see FIG. 2). Vertical water pipes 14 each have a plurality of vertically spaced water nozzles 18, 20, and 22. Vertical pipes 16 each have a plurality of vertically spaced water nozzles 24, 26, and 28.

The nozzles 18, 20, and 22 on vertical water pipes 14 are along different horizontal planes from the nozzles 24, 26, and 28, respectively of the vertical water pipes 16. Thus the nozzles on each vertical pipe are located along different horizontal planes from the nozzle on each of the adjacent vertical pipes. The spacing between the vertical water pipes 14 and 16, and the spacing of the water nozzles is such as to minimize the interaction of the sprayed water droplets which as mentioned above, we have found provides the greatest efficiency for cooling the water.

If larger amounts of water are to be cooled, additional concentric circles of water pipes may be added to the system. Of course, different concentric arrangements than circles may be used, such as polygons. The basic feature is the arrangement of the vertical pipes with the nozzles of each vertical pipe being along different horizontal planes than the nozzles of the adjacent vertical pipes and spaced so as to minimize the water droplet interactions.

Figure 4:
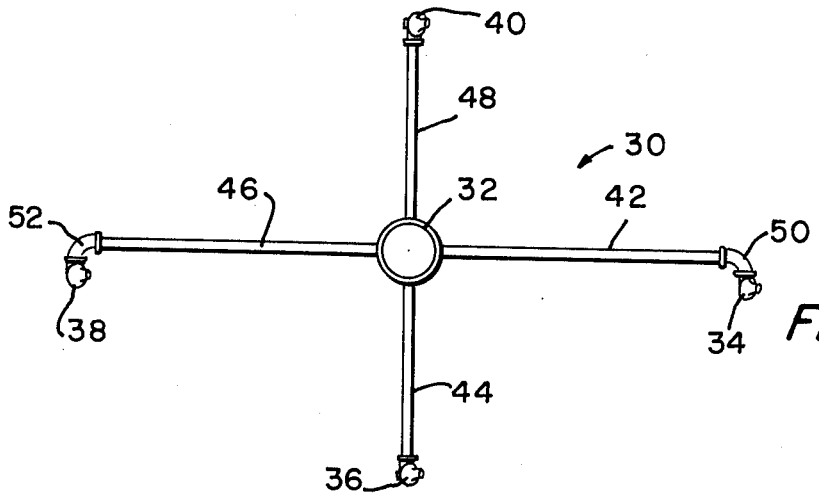
FIG. 4 is a view taken along lines 4—4 of FIG. 3.
Figure 3:
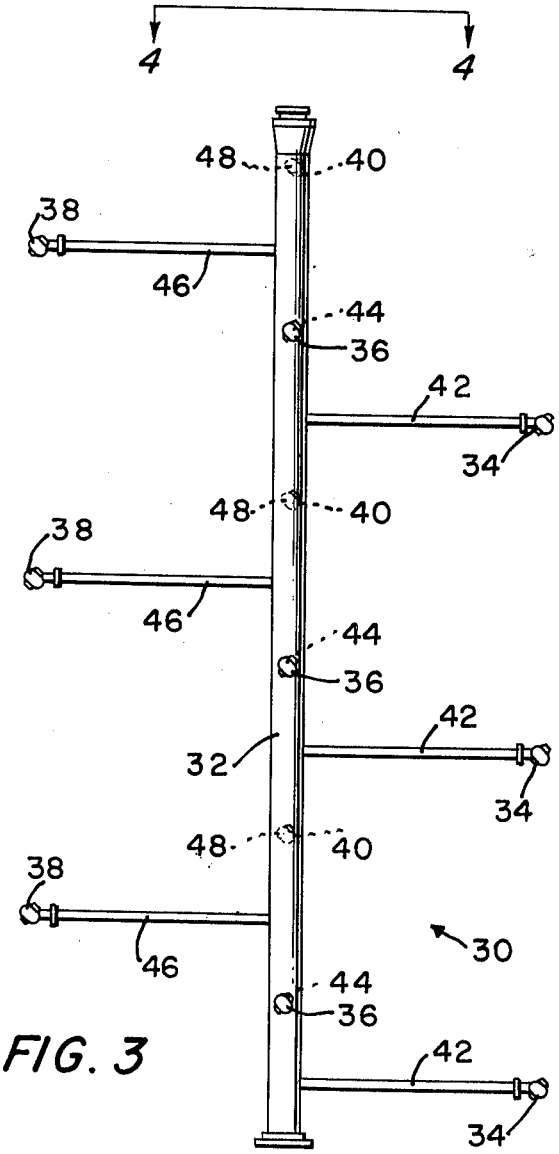
FIG. 3 is a side elevational view showing a second modification of vertical pipe.

FIG. 3 and FIG. 4 show a second preferred embodiment of my invention. A spray tree generally indicated by the number 30 includes a vertical water pipe 32. A plurality of vertically spaced water nozzles 34, 36, 38, and 40 are mounted on horizontal arms or branches 42, 44, 46, and 48 respectively, extending from vertical water pipe 32 (see FIG. 3 and FIG. 4). All of the nozzles are adapted to direct the water at an angle with respect to the horizontal and note particularly by reference to FIG. 4, that any four vertically consecutive nozzles are circumferentially spaced from one another by an approximate 90° angle so that a line interconnecting all the nozzles in a particular tree 30 would be in the form of a spiral. Note also, that all of the nozzles direct the water translationally in the same general direction (toward the right, looking at FIG. 4). Note also that elbows 50 connect nozzles 34 to arms 42 and elbows 52 connect nozzles 38 to arms 46. The provision of these elbows puts the nozzles 34 and 38 to one side of the vertical pipe 32 so that impingement on the vertical pipes in an arrangement of vertical pipes of water issuing from these nozzles will be minimized thus, adding to the minimization of water droplet interaction and contact of the water droplets against any mechanical elements.

Figure 5:
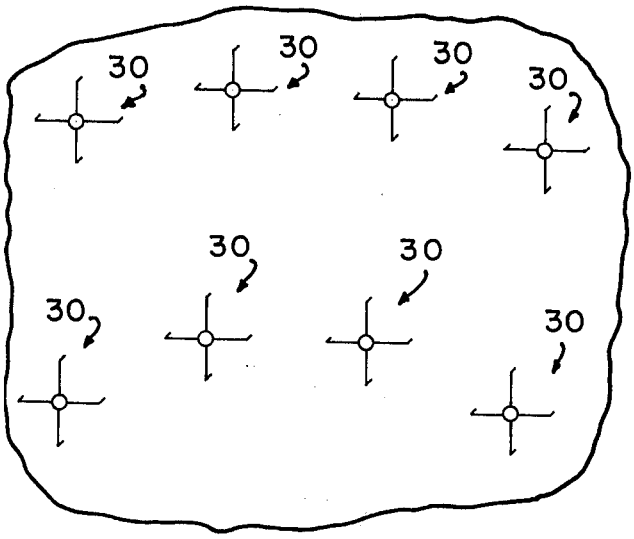
FIG. 5 is a schematic view showing part of an arrangement of two groups of vertical pipes arranged about a central area in two concentric circles.

FIG. 5 shows an arrangement of two groups of spiral trees concentrically arranged about a central area. The first group would consist of an inner circle, (only partially shown in FIG. 5) with the second group including the spiral trees in the outer circle (also only partially shown in FIG. 5). All of the nozzles on all of the trees are arranged to direct the water droplets at a angle with respect to the horizontal and all of the sprays are also directed toward the central area or center of the circles. Of course, other concentric arrangements of groups can be utilized, if desired, such as concentric arrangements of polygons or rectangles or squares. Therefore, as used in this application and the attached claims, the work "groups" which are concentrically arranged are meant not only to include concentric circular arrangements but also these other concentric arrangements as well.

Figure 6:
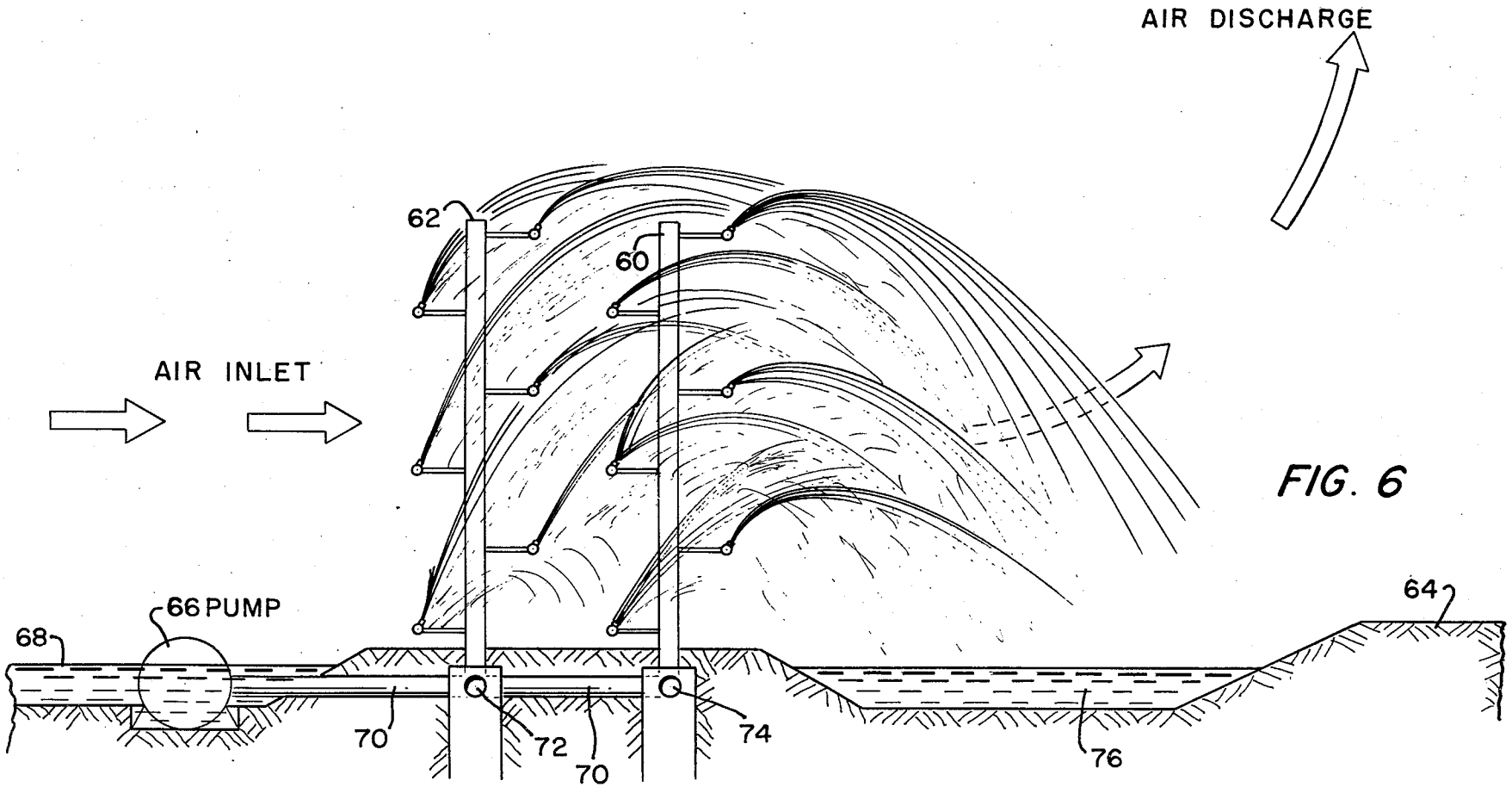
FIG. 6 shows a radial slice of a typical annular arrangement of vertical pipes.

FIG. 6 is a radial slice of a typical annular spray arrangement, schematically shown. In the spray trees 60 and 62 only the six in-line nozzles are shown. There are three more to either side of each tree. Also, the trees 60 would form an inner concentric circle about the center of the mound 64 and the trees 62 would form an outer concentric outer circle about the center of mound 64.

The pump 66 pumps hot water from the hot water supply reservoir 68 through the distribution manifolds 70 to the ring headers 72 and 74. The water from ring header 72 is fed up the trees 62 and the water from ring header 74 is fed up the trees 60. The water is sprayed from the trees into the cold water canal or reservoir 76.

The spacing between the groups of vertical water pipes the spacing of the vertical water pipes in each group, and the location of the nozzles are carefully chosen to minimize the interactions of the water droplets from the nozzles. For example, a spray tree may be 18 feet high with 12, 1½ inch hollow cone spray nozzles oriented 55 degrees above the horizontal. With 26 PSIG feeding the distribution headers, the nozzle pressures of a spray tree will vary from 17 PSIG to at least 12 PSIG at the top nozzle. With a flow rate of 550 GPM/tree a 110,000 GPM module consists of 200 trees arranged in two concentric rings about 27 feet apart. This arrangement allows a projectory from the nozzles to combine with controlled interference while not exceeding acceptable water loadings. The spacing between the trees 60 in the inner circle as well as the spacing between the trees 62 in the outer circle may typically be about 12 feet.

The elevation and horizontal locations of the individual nozzles on a tree may be carefully selected to establish the proper spray pattern for optimum air reception and cooling performance. This optimized geometry gives water loadings wich minimize the conglomeration of the droplets for good heat transfer and the nozzle orientation is uniform to maintain a maximum air flow.

The discharge from the double ring spray header is to the center where the mound 64 is located. This helps to produce the vertical components of the air plume. This arrangement minimizes turning losses of the exhaust plume and prevents the exhaust plume from one segment interfering with another segment of the ring during high winds.

I claim:

1. In an arrangement for cooling large quantities of water, a vertical water pipe; a plurality of vertically spaced water nozzles mounted on the water pipe with each water nozzle being circumferentially spaced from each adjacent water nozzle, by an approximate 90° angle in a manner such that a line interconnecting the nozzles would be a spiral, the water exits of all of the nozzles being unobstructed and facing the same general direction to direct the flow of water in the same general translational direction.

2. The arrangement of claim 1 wherein: each nozzle is connected to the vertical pipe by a horizontal arm, and the water exits of the nozzles are at an acute angle to the horizontal to direct water at an angle with respect to the horizontal.

3. An arrangement for cooling water comprising: at least two groups of vertical water pipes concentrically arranged about a central area; a plurality of vertically spaced water nozzles mounted on each vertical water pipe, with each nozzle on said vertical water pipe being circumferentially spaced from each adjacent water nozzle on said vertical water pipe, the water exits of all of the nozzles on all of the vertical pipes in said at least two groups being unobstructed and at an angle to the horizontal and facing the central area to direct the flow of water at an angle from the horizontal and toward the central area; the spacing between the groups of vertical water pipes, the spacing of the vertical water pipes in each group, and the location of the nozzles, minimizing the interaction of the water droplets from the nozzles.

4. An arrangement in accordance with claim 3 wherein the groups are concentric circles, and any four vertically consecutive nozzles on each vertical water pipe are circumferentially spaced from one another by an approximate 90° angle.

* * * * *